US005560130A

United States Patent [19]

Bapst

[11] Patent Number: 5,560,130

[45] Date of Patent: Oct. 1, 1996

[54] EXCAVATION APPARATUS FOR ATTACHMENT TO THE REAR OF A TRACTOR

[76] Inventor: Wilson D. Bapst, 452 Callahan Rd., Jackson, Ohio 45640

[21] Appl. No.: 420,774

[22] Filed: Apr. 12, 1995

[51] Int. Cl.[6] ..... E02F 3/64

[52] U.S. Cl. ..... 37/435; 37/412; 172/445.1; 172/634.5; 172/271

[58] Field of Search ..... 37/403, 404, 409, 37/412, 432, 435, 443, 468; 172/445.1, 684.5, 271; 403/43, 44, 45, 46, 47, 48; 414/703

[56] References Cited

U.S. PATENT DOCUMENTS

| | | | |
|---|---|---|---|
| Re. 15,704 | 10/1923 | Reynolds | 37/435 |
| 2,273,875 | 2/1942 | Livesey et al. | 37/126 |
| 2,295,850 | 9/1942 | King | 37/126 |
| 2,417,595 | 3/1947 | Heath | 37/435 X |
| 2,433,019 | 12/1947 | Arps | 37/412 X |
| 2,496,874 | 2/1950 | Holopainen | 37/126 |
| 2,566,547 | 9/1951 | Bartlett | 37/403 X |
| 2,677,203 | 5/1954 | Poirier | 37/403 X |
| 2,774,154 | 12/1956 | McNeice | 37/435 |
| 2,846,094 | 8/1958 | Pilch | 37/403 X |
| 2,930,151 | 3/1960 | Brundage et al. | 37/126 |
| 3,503,455 | 3/1970 | Derman | 172/271 |
| 3,912,092 | 10/1975 | Bolton et al. | 37/403 X |
| 3,916,543 | 11/1975 | Poche | 37/93 |
| 4,261,684 | 4/1981 | Norton et al. | 37/403 X |
| 4,484,636 | 11/1984 | Hodgson, Jr. | 172/454 |
| 4,869,002 | 9/1989 | Glenn | 37/403 |
| 4,895,211 | 1/1990 | Harris | 172/271 |
| 5,245,771 | 9/1993 | Walsh | 172/484 X |

FOREIGN PATENT DOCUMENTS

| | | |
|---|---|---|
| 859920 | 1/1961 | United Kingdom . |

*Primary Examiner*—Terry Lee Melius
*Assistant Examiner*—Victor Batson
*Attorney, Agent, or Firm*—Sidney W. Millard; Kremblas, Foster, Milliard & Pollick

[57] ABSTRACT

A trenching apparatus for attachment to a three-point hitch on a tractor includes a bucket pivotally mounted on the lower end of a mounting post. The mounting post is held in position by a pair of spaced apart generally horizontal beams connected to a frame to define a parallelogram. The frame is connected to the three-point hitch in conventional fashion. The mounting post and support beams are configured to extend rearwardly of the mounting frame between two parallel planes extending along the sides of the excavation bucket toward the mounting frame and vertically thereof.

18 Claims, 5 Drawing Sheets

EXCAVATION APPARATUS FOR ATTACHMENT TO THE REAR OF A TRACTOR

FIELD OF THE INVENTION

This invention relates to an attachment to the three-point hitch on the back of a tractor for excavating soil and preferably for digging trenches.

BACKGROUND OF THE INVENTION

Apparatus for digging trenches or general excavation on large construction projects is usually accomplished with a backhoe or a bulldozer. However, there is a need for a digging apparatus which may be used on small scale projects by farmers or others who have access to tractors such as may be used in a farming, sod growing or horticulture type environment.

Tractors have had three-point hitches on their rear-ends for many years and the operating features are well known and need not be described in detail. However, there are different attachment mechanisms of a minor nature as between different brands of tractors and even the same brand of tractor may have a different hook-up mechanism from one year to the next.

An example of a structure attachable to a three-point hitch on the back of a tractor is illustrated in the patent to Livesey et al., U.S. Pat. No. 2,273,875. It includes a mounting apparatus for supporting a "drag pan" which is designed to scoop loose material from some surface and then the full pan is lifted vertically and transported to a dump site where the bottom of the pan is released. Thereby, the grain, sand or the like, is dumped at the desired location by the bottom of the pan pivoting from a forward pivot axis such that the contents of the pan drain out the back.

A patent to King, U.S. Pat. No. 2,295,850, is another example of a three-point hitch connection to a rear mounted excavator for mounting on a tractor. A framework mounts a bucket with a forward cutting edge. The apparatus is structured to excavate a broad path of limited depth. The bucket is designed to dig into the soil in a trench having a width which is approximately equal to the width of the axle mounting the wide based rear wheels of the tractor. Tilting and dumping of the bucket is achieved by a manual operation controlled by the operator of the tractor using levers and cables.

A patent to Holopainen, U.S. Pat. No. 2,496,874, is another example of mounting a digging apparatus on the rear of a tractor using a three-point hitch. The mounting apparatus includes a parallelogram structure of beams separated by struts. On their lower end is a bucket designed for ditch digging. Indeed, the structure disclosed is obviously quite effective in digging shallow ditches but it is limited in its ability to penetrate to any great depth because the mounting structure of the bucket is secured to the bucket transversely of the digging edge. Therefore, the side mounting limits the depth of penetration into the soil by the bucket. More specifically, the side mountings of the bucket will not allow the bucket to extend into a trench of the same width as the bucket to any greater depth than the space between the bottom of the bucket and the bottom edge of the bucket mounting hardware. The bucket is structured to dump its contents in response to a hand operated cord connected to a spring-locked latch at one rear edge of the bucket.

A patent to Brundage et al., U.S. Pat. No. 2,930,151, discloses another apparatus for mounting a scoop on the rear of a tractor and it includes a hand manipulated cord for dumping the contents. Another feature of the Brundage et al. patent is the reversible mounting of the bucket which allows the bucket to scoop earth, grain or the like by the bucket, but the scooping operation takes place in either the forward or rear direction, depending upon the desired mounting of the bucket.

A patent to Poche, U.S. Pat. No. 3,916,543, discloses a highly mechanized trenching apparatus which includes a bucket for digging soil in a trench and an associated shredder for chopping the excavated soil and discharging it transversely of the bucket. The appearance is somewhat similar to snow being discharged by a snow blower. The depth of digging by the trenching apparatus is limited only by the height of the discharge duct located transversely of the excavation bucket and the length of the mounting arm on the rear of the tractor.

All these patents disclose a basic concept of mounting a digging or scooping apparatus on the rear of a tractor by connecting support apparatus to the three-point hitch. What they do not disclose is the concept of digging a trench of relatively narrow width such that the wheels of the tractor span the width of the trench while allowing the digging bucket to extend downwardly into the trench to a depth several times the height of the bucket itself. The structure disclosed in the above patents is relatively flimsy in its mounting and excavation components and is obviously not suited for long-term use in digging a series of deep trenches.

SUMMARY OF THE INVENTION

This invention discloses an attachment for the rear of a tractor for use in excavation and has a rugged support frame including a pair of generally horizontal, spaced apart, beams mounted between a support post and an attachment frame. One of the beams is adjustable as to length for purposes of adjusting the angle of penetration of the digging edge of a bucket into the soil and this angular deflection is accomplished by rotating the adjustable beam so as to adjust the angle of the support post which has the bucket attached thereto in pivotal relationship.

The other of the two spaced apart beams extends beyond the support frame for direct engagement with one part of the three-point hitch on the rear of the tractor. This allows the supporting framework for this invention, and specifically the length of the beam for attaching to the tractor, to be adjustable by telescoping elements which are locked into position by a pin passing through openings in the telescoping elements.

A latch holds the bucket in stationary position with respect to its support post and the latch is urged into latching position by a spring bias. The latch is disengaged by the tractor operator using a cord or cable extending from the latch to a location near the driver seat on the tractor.

The mounting framework, latch and support structure are all mounted on the three-point hitch and those elements to the rear of the mounting frame have a total width narrower than the width of the bucket itself. Thereby the bucket can extend downwardly into a trench to dig soil from the bottom without any part of the attachment engaging the sidewalls of the trench except for the sidewalls of the bucket itself. In other words, there are no obstructing side extensions on the bucket of this invention which in any way impairs the ability of the operator to dig a trench of substantial depth for a trench which is of less width than the width of the rear wheels of the tractor.

Objects of the invention not fully understood from the above will be fully appreciated upon a review of the drawings and the detailed description of the preferred embodiments which follows.

DETAILED DESCRIPTION OF THE PREFERRED EMBODIMENT

This invention involves an attachment to the three-point hitch on the rear of a tractor, preferably, to excavate soil to form a trench. All of the excavation bucket, mounting apparatus associated therewith and latch release are configured to be narrower than the width of the sidewalls of the bucket.

Figure 1:
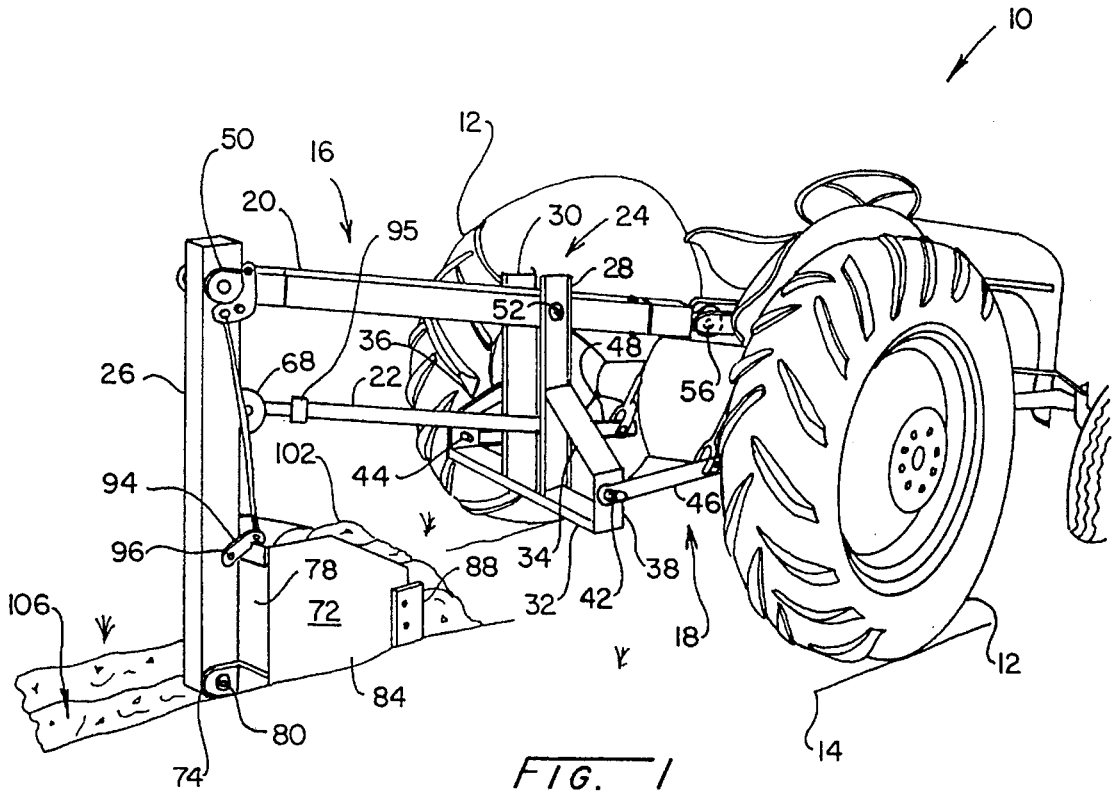
FIG. 1 is a perspective view of a tractor having the attachment of this invention mounted thereon and digging a trench.

Looking now to FIG. 1, a tractor 10 having a pair of spaced apart rear wheels 12 is supported on a soil surface 14. An attachment indicated generally at 16 is mounted on the rear of the tractor 10 by a conventional three-point hitch indicated generally at 18.

The attachment 16 includes a pair of beams 20, 22 which are spaced apart vertically but are generally aligned parallel with each other. Both beams are connected to a forward frame 24 and a rear support post 26.

Support frame 24 includes a pair of back-to-back, 4 inch, channel irons 28, 30 secured together at their lower ends by a cross-beam 32 which is also in the shape of a channel iron.

A pair of angularly downwardly extending struts 34, 36 project from about the central portion of channel irons 28, 30 to a pair of side plates 38, 40 which bridge between the outer ends of struts 34, 36 and crossbeam 32 to provide a stable, rigid mechanical frame. Connection points 42, 44 on side plates 38, 40 provide a connection for the rearwardly projecting arms 46, 48 of the conventional three-point hitch.

Figure 7:
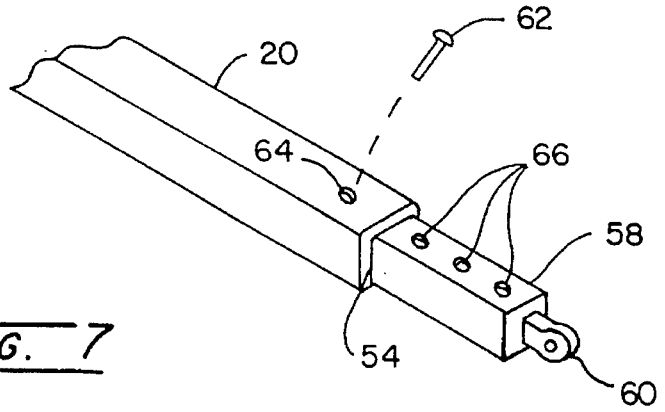
FIG. 7 is a fragmentary perspective view of the telescoping beam extending for connection to one part of the three-point hitch.
Figure 8:
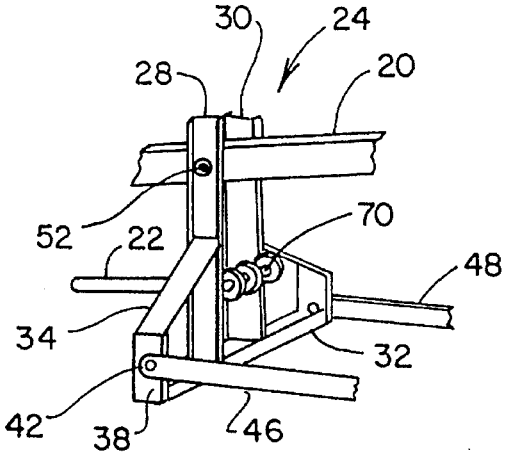
FIG. 8 is a fragmentary perspective view of the mounting frame of this invention and specifically illustrating the connection to one of the beams mounted to the frame by a shear pin.

Beam 20 is preferably a square shaped metal duct best illustrated in FIG. 7. It projects from a clevis-type connection 50 on the square shaped post 26 forwardly between channel irons 28, 30 where it is pivotally connected at 52. Looking particular to FIG. 7, beam 20 terminates at 54 and a telescoping extension 58 includes an eyelet 60 for engagement with a hitch connection 56. Telescoping extension 58 is adjustable by sliding in or out of beam 20 to accommodate different configurations of conventional three-point hitches. It is secured at a specific length after the proper extension is achieved by a locking pin 62 which projects through an aperture 64 in beam 20 which will be aligned with one of the plurality of apertures 66 in extension 58.

Support beam 22 is pivotally connected to post 26 by a pivotal connection 68 which includes a pair of forwardly extending flanges extending forwardly from post 26 and a pin projecting between the two flanges and securing the rear-most end of beam 22. Beam 22 extends forwardly for a similar connection between a pair of plates or flanges extending forwardly of the two channel irons 28, 30 to provide support for a horizontally extending pivotal pin connection 70. It is preferred that the pin connection 70 be a shear pin which will break upon the application of force to beam 22 in excess of a threshold amount. The purpose is to prevent severe damage to the support apparatus for the trenching tool should the bucket engage a large rock, root or other obstruction during the trenching operation. It is clear that the shear pin could as easily be located at pivot point 68 connected to the support post 26 if desired. Indeed, it is contemplated that beam 22 could be structured as a pair of telescoping cylindrical elements pinned together with a shear pin intermediate post 26 and frame 24.

An excavation bucket 72 is generally rectangular in shape upon a side view and generally square in shape when viewed from the front or rear. It is pivotally supported on post 26 by a pair of plates or flanges 74, 76 projecting from the rear wall 78 of the bucket and penetrated by a pin 80. Bottom 82 and side walls 84, 86 project from rear wall 78 toward an open forward end 88 of the bucket which includes a sharp cutting edge 90 at the bottom 82 in the form of a plurality of teeth 92.

A spring biased hook or latch 94 is pivotally mounted at 96 to the post 26 and may be released by the operator of the tractor by tensioning a cord 98 which extends over post 26 and forwardly along beam 20 to be manually operated by the driver.

Figure 11:
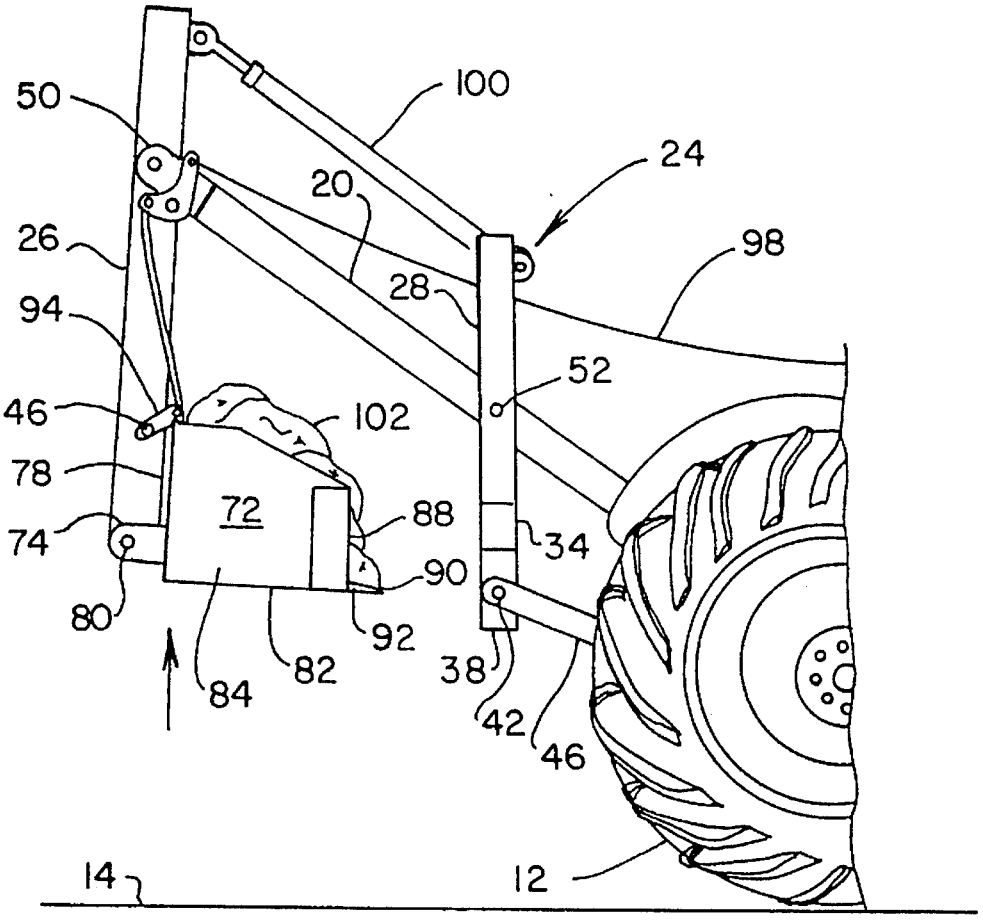
FIG. 11 is side elevational view of the attachment of this invention mounted on the rear of a tractor similar to FIG. 2 but showing an alternative embodiment with the locations of the horizontally extending beams reversed as to positioning.

FIG. 11 illustrates an alternative embodiment where the telescoping beam 20 is the lower of the two beams and the second or adjustable length parallel beam 100 is pivotally mounted to post 26 and frame 24 in the same manner as beam 22 in FIGS. 1–6. The only difference being that the shear pin will be located as a connection with the upper beam rather than the lower beam 22.

Figure 9:
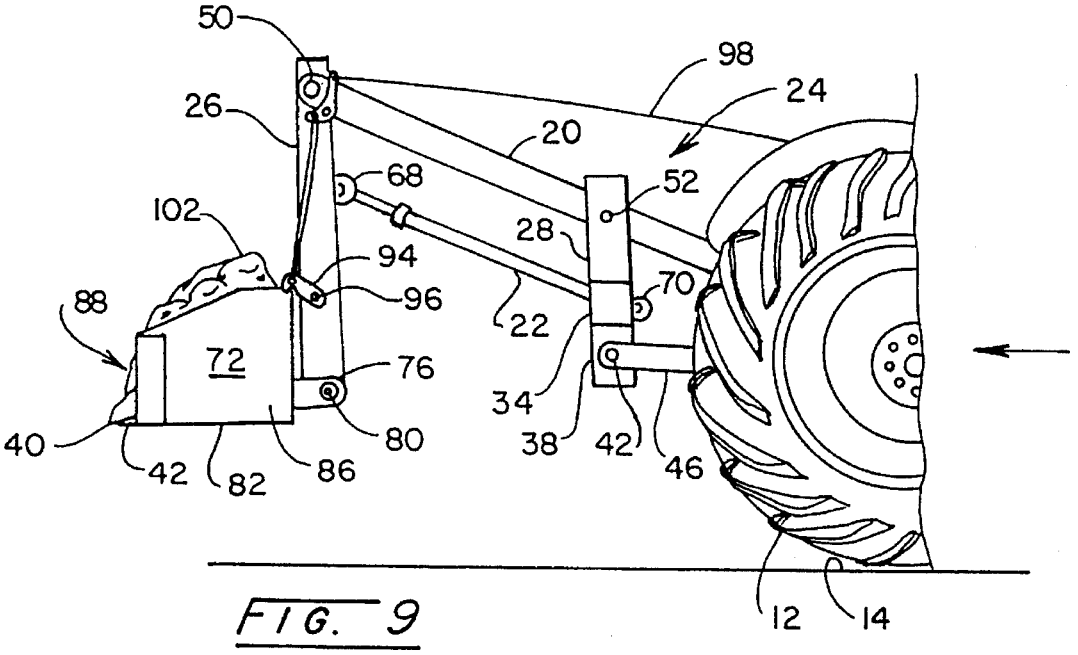
FIG. 9 is a fragmentary sectional view similar to FIG. 2 but illustrating an alternative embodiment with the bucket reversed on its mounting post such that excavation by the bucket may be achieved upon the backing of the tractor rather than the tractor moving forward.
Figure 10:
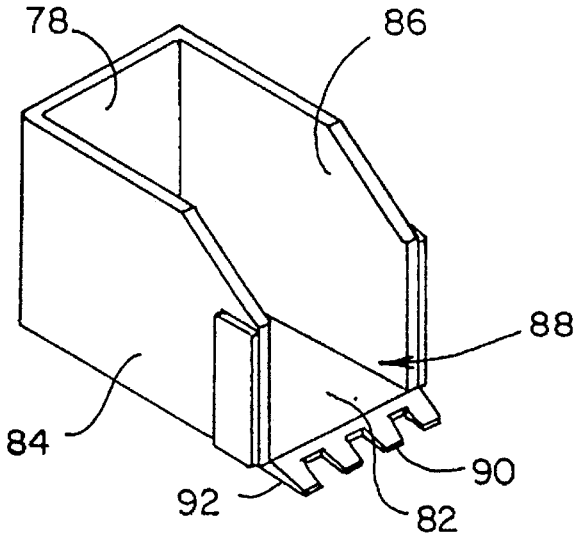
FIG. 10 is a perspective view of the excavating bucket of this invention.

FIG. 9 illustrates another alternative embodiment where the bucket 72 is mounted on post 26 to face away from the tractor rather than being mounted facing the tractor as illustrated in FIG. 1 where the bucket 72 is between post 26 and frame 24. In the FIG. 9 embodiment, the bucket 72 serves to excavate soil with the tractor moving backwards. This embodiment is useful where there is a desire to excavate soil or construct a trench leading toward a wall or some other obstruction which would prevent the tractor from moving toward the obstruction. The alternative embodiment is accomplished by removing pin 80 and reversing the bucket to the rear side of post 26 and then reinserting the pin. The latch 94 simply flips over to the opposite side for latching to the upper edge of the rear wall 78 of the bucket.

Figure 2:
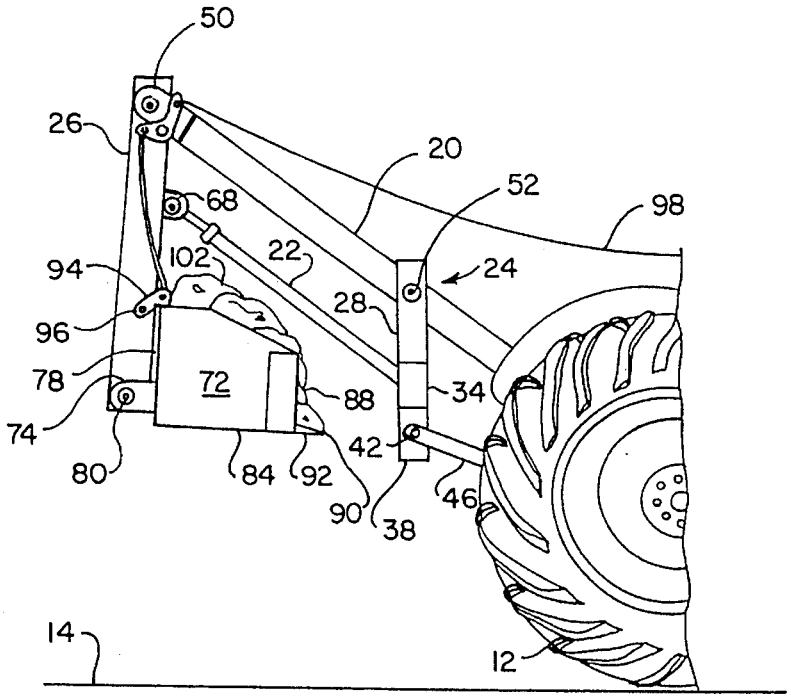
FIG. 2 is a fragmentary side elevational view of the bucket and attachment of this invention with the bucket full and elevated from its digging position.
Figure 3:
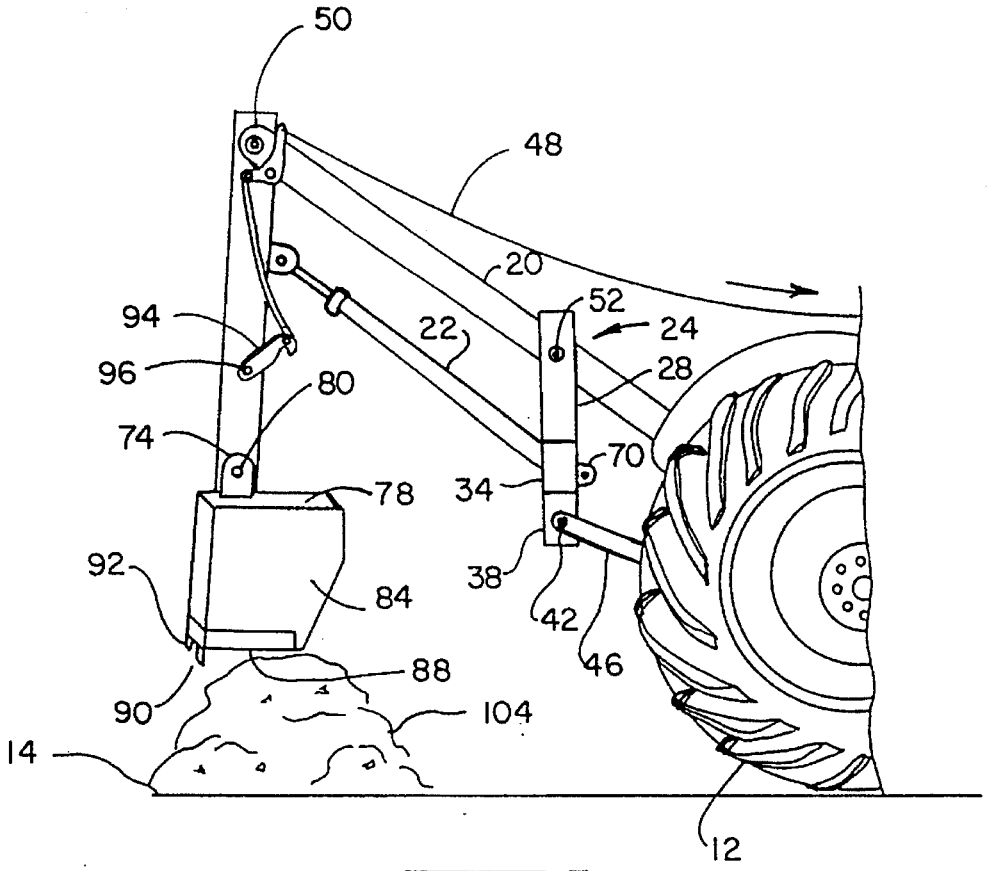
FIG. 3 is a fragmentary side elevational view of a tractor with the attachment of this invention mounted thereon and with the latch of the bucket released to dump the soil excavated by the bucket.
Figure 4:
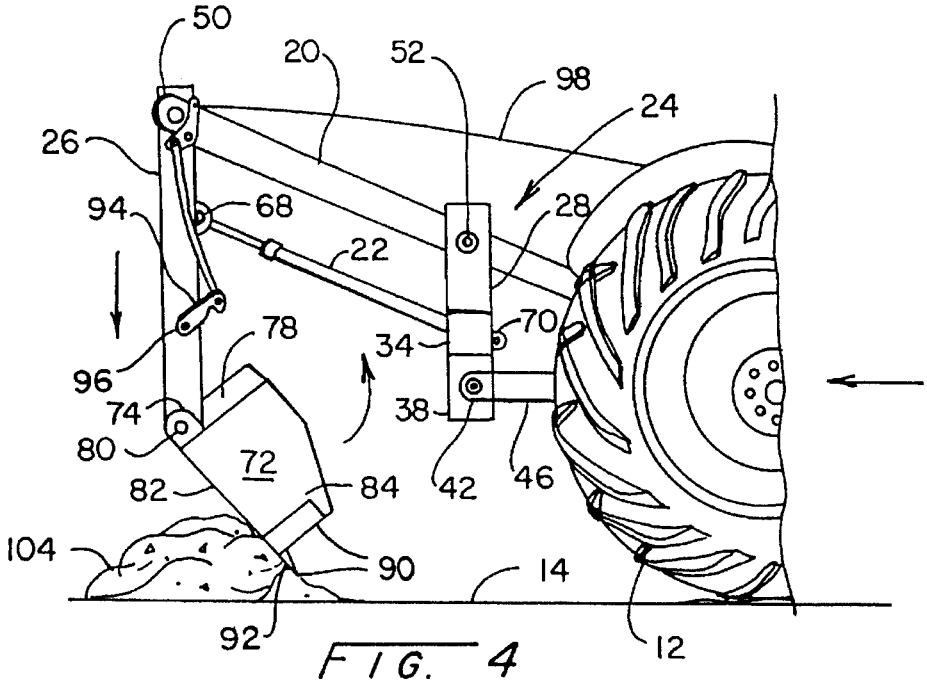
FIG. 4 is a fragmentary side elevational view of the tractor and attachment of this invention similar to FIG. 3 but with the tractor moving backward and the bucket being urged back to latching position by friction of the ground engaging the lower part of the bucket and causing it to pivot upward in counter clock-wise direction to latching position.

In operation, beam 22 is rotated within a turnbuckle 95 to adjust its length and thereby adjust the angle of post 26 with respect to the vertical. Because bucket 72 is rigidly secured in place by latch 94 with the rear wall 78 thereof being generally parallel with post 26, adjustment of the angle of post 26 adjusts the angle of the bottom 82 of the bucket and thereby the angle of penetration of the sharp cutting edge 90 into the soil. After a suitable angle of penetration is achieved, bucket 72 is lowered to the top surface of the soil to be excavated and the tractor 10 moves forward. Teeth 92 penetrate the soil and the excavated material moves rearwardly in bucket 72 toward rear wall 78 until it is full as illustrated in FIG. 2. Then the bucket is lifted by the three point hitch and because the two beams 20, 22 are essentially parallel in the parallelogram formed by the beams, the post 26 and the frame 24, the angle of the bottom 82 of the bucket remains essentially the same as it was in penetrating the ground. Thereby the excavated soil does not fall out of a tipping bucket. It will be understood that there may be a slight tipping of the angle of bottom 82 upon the lifting of bucket 72, depending upon the slight difference in the length of the beams between the post and frame but under ordinary conditions this difference in length will be very small.

Tractor 10 moves to a dumping site for the excavated material 102 and the tractor operator dumps the contents by placing cord 98 in tension which disengages latch 94 from the upper edge of rear wall 78 of bucket 72. Gravity and the weight of soil 102 cause the bucket to pivot in a vertical arc about pivot point 80 and thereby the soil is dumped on a suitable pile 104.

To remount the bucket 72 in operable excavation position, the bucket is lowered until the teeth 92 engage soil surface 14 or the bottom wall 82 engages pile 104 such that a frictional engagement is achieved and thereby the tractor can back up and the friction of the soil or the pile will pivot the bucket 72 back into latched condition which will be achieved due to the spring bias of the latch.

Figure 5:
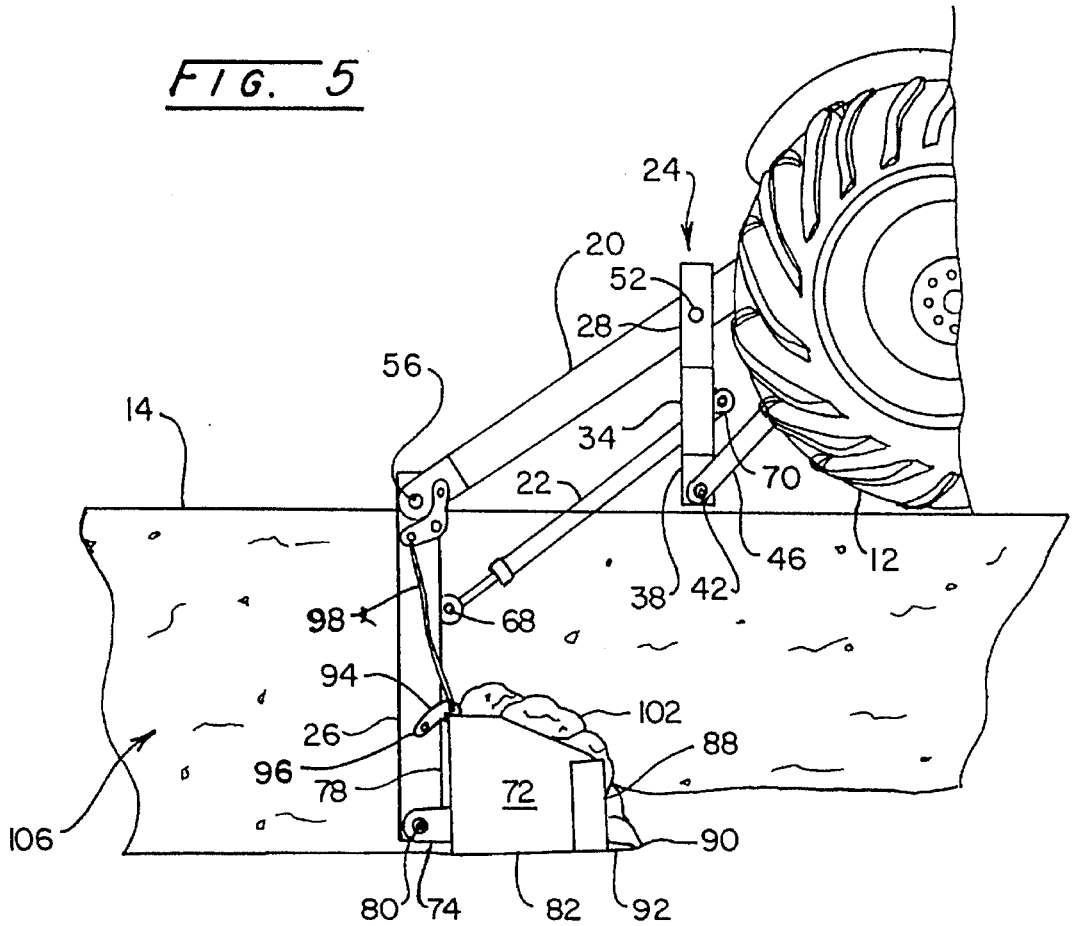
FIG. 5 is a fragmentary side elevational view of the attachment of this invention mounted on the rear of a tractor and showing its extension deep into a trench and excavating soil from the bottom thereof.
Figure 6:
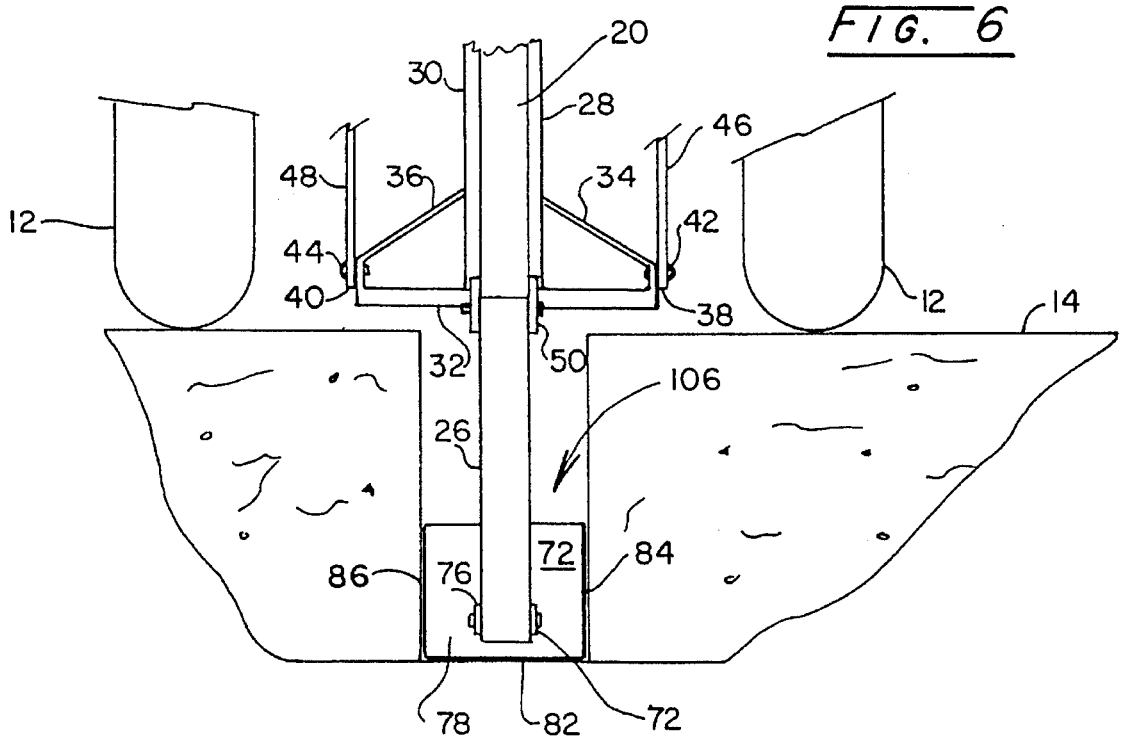
FIG. 6 is a fragmentary rear elevational view of the structure of FIG. 5.

A particularly important feature of this invention is the configuration of the post 26, beams 20, 22, the beam connections to post 26 and the pivotal connection of bucket 72 to post 26. With the illustrated structure, a pair of parallel planes are defined extending along the widest part of bucket 72 forward to the frame 24 and vertically thereof. These parallel planes being co-planer with bucket sidewalls 84, 86 are not penetrated by any part of the apparatus to the rear of frame 24 during the excavation. This allows the excavation of a deep trench 106 as indicated in FIG. 6 between the rear wheels 12 of the tractor. Note that there are no parts of the apparatus projecting transversely such that they engage the sidewalls of the trench 106 except for the side walls 84, 86 of the bucket. Any attachment structure or other elements of the frame which extend transversely of the two parallel planes generally corresponding to the sides of trench 106 limit the depth of penetration of bucket 72 which is undesirable. This structure allows the rear wheels 12 of tractor 10 to straddle trench 106 while the bucket extends down below the surface of the soil to excavate to a further depth than the bottom of the trench as illustrated in FIG. 5.

Having thus described the apparatus in its preferred embodiment, it will be clear to those having ordinary skill in the art, that certain modifications may be made without departing from the spirit of the invention. It is not intended that the invention be limited by the words used in describing the same, nor the drawings illustrating the same. Rather it is intended that the invention be limited only by the scope of the appended claims.

I claim:

1. An attachment for the rear of a tractor for use in excavation, said attachment including a vertically extending bucket support post, a vertically extending attachment frame, a bucket pivotally attached to a lower end of said support post, and a pair of adjustable support beams pivotally attached to both said post and said frame, said beams being vertically spaced apart and of invariable length during use in excavation, a latch for holding said bucket stationary with respect to said post, a latch release to allow said bucket to pivot in a vertical arc about a horizontal axis with respect to said post, connections on said frame to receive mating connections on the rear of a tractor to allow said tractor to move said attachment to perform an excavation, said bucket having a bottom of a width extending between a pair of sidewalls, said bucket includes a cutting edge at its leading lower surface between said sidewalls at said bottom and said bucket being open above said cutting edge to receive excavated material through said opening, which material will move toward said post upon the movement of said tractor, said bucket being fixed in stationary position during excavation, said post and support beams being mounted to fit between two parallel planes, each of said planes extending along a bucket sidewall toward said attachment frame and vertically parallel with said post, without any part of said bucket, post, support beams or the associated mounting and connecting structure extending transversely to break the surface of either of said planes.

2. The attachment of claim 1 wherein, prior to use in excavation, one of said beams is adjustable as to length between said frame and post to adjust the angle of said post with respect to vertical.

3. The attachment of claim 2 wherein said bucket sidewalls extend from said forward opening to a rear wall, in latched condition said rear wall being adjacent and generally parallel with said post.

4. The attachment of claim 3 including a pressure relief connection with said one beam to allow free movement of said one beam upon the application of pressure to said pressure relief connection in excess of a threshold amount.

5. The attachment of claim 4 wherein said pressure relief connection comprises a shear pin securing said one beam to said frame.

6. The attachment of claim 5 wherein said one beam is adjustable by rotation in a turnbuckle.

7. The attachment of claim 6 wherein the other said beams is adjustable as to length between said frame and said tractor by a telescoping extension.

8. The attachment of claim 7 wherein said adjustment of the length of said one beam adjusts the angle of penetration of said bucket cutting edge into material to be excavated.

9. The attachment of claim 8 wherein said pivotal attachment of said bucket to said post is by way of a flange projecting from said rear bucket wall toward said post, said pivotal connection being between said flange and said post, such that pivoting of said bucket rear wall upon a release of said latch is in an arc away from said post which is caused by gravity.

10. The attachment of claim 1 wherein said bucket sidewalls extend from said forward opening to a rear wall, in latched condition said rear wall being adjacent and generally parallel with said post.

11. The attachment of claim 1 including a pressure relief connection with said one beam to allow free movement of said one beam upon the application of pressure to said pressure relief connection in excess of a threshold amount.

12. The attachment of claim 11 wherein said pressure relief connection comprises a shear pin securing said one beam to said frame.

13. The attachment of claim 1 wherein said bucket is mounted to said post between said post and said frame.

14. The attachment of claim 1 wherein said bucket is mounted to said post and extends in a direction away from said frame.

15. The attachment of claim 2 wherein the other said beams is adjustable as to length between said frame and said tractor by a telescoping extension.

16. The attachment of claim 2 wherein said adjustment of the length of said one beam adjusts the angle of penetration of said bucket cutting edge into material to be excavated.

17. The attachment of claim 2 wherein said adjustable beam is below the other of said beams.

18. The attachment of claim 2 wherein said adjustable beam is above the other of said beams.

* * * * *